US008679711B2

(12) United States Patent
Osada et al.

(10) Patent No.: US 8,679,711 B2
(45) Date of Patent: Mar. 25, 2014

(54) ELECTROPHOTOGRAPHIC PHOTORECEPTOR

(75) Inventors: Morio Osada, Tokyo (JP); Takeshi Ishida, Tokyo (JP); Toshiyuki Fujita, Tokyo (JP); Seisuke Maeda, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 261 days.

(21) Appl. No.: 13/163,248

(22) Filed: Jun. 17, 2011

(65) Prior Publication Data

US 2011/0318681 A1 Dec. 29, 2011

(30) Foreign Application Priority Data

Jun. 28, 2010 (JP) ..... 2010-146027
Jun. 29, 2010 (JP) ..... 2010-147294

(51) Int. Cl.
*G03G 15/04* (2006.01)

(52) U.S. Cl.
USPC ..... 430/66; 430/69

(58) Field of Classification Search
USPC ..... 430/66, 69
See application file for complete search history.

(56) References Cited

U.S. PATENT DOCUMENTS

2003/0216497 A1 * 11/2003 Nakagawa et al. ..... 524/285

FOREIGN PATENT DOCUMENTS

| | | | |
|---|---|---|---|
| JP | 2002-333733 | | 11/2002 |
| JP | 2006-071856 | * | 3/2006 |
| JP | 2008-065231 | | 3/2008 |
| JP | 2008-090118 | | 4/2008 |
| JP | 2009-069241 | | 4/2009 |
| JP | 2009-069541 | | 4/2009 |
| JP | 2009-080401 | | 4/2009 |
| JP | 2009-251140 | | 10/2009 |
| JP | 2010-039123 | | 2/2010 |
| JP | 2010-134073 | | 6/2010 |

OTHER PUBLICATIONS

Machine translation of JP2006-071856.*

Japanese Office Action, Notice of Reasons for Refusal, Patent Application No. 2010-146027, date mailed: Dec. 17, 2013 (2 pages).

English translation of Japanese Office Action, Notice of Reasons for Refusal, Patent Application No. 2010-146027, date mailed: Dec. 17, 2013 (3 pages).

* cited by examiner

*Primary Examiner* — Thorl Chea
(74) *Attorney, Agent, or Firm* — Lucas & Mercanti, LLP

(57) ABSTRACT

An electrophotographic photoreceptor is disclosed, comprising, on an electrically conductive substrate, a photosensitive layer and a surface layer provided sequentially in that order, in which the surface layer is a layer formed by polymerizing a polymerizable compound (I) containing seven to ten functional groups and exhibiting a reactive group equivalent of not more than 140 and not less than 100.

9 Claims, 2 Drawing Sheets

ELECTROPHOTOGRAPHIC PHOTORECEPTOR

This application claims priority from Japanese Patent Application Nos. 2010-146027, filed on Jun. 28, 2010, and 2010-147294, filed on Jun. 29, 2010, which are incorporated hereinto by reference.

FIELD OF THE INVENTION

The present invention relates to an electrophotographic photoreceptor of enhanced durability.

BACKGROUND OF THE INVENTION

In recent years, an organic photoconductors containing an organic electrically conductive substance has been employed for an electrophotographic photoconductor (which is hereinafter also denoted as a photoreceptor). Such an organic photoconductor is advantageous, as compared to other photoconductors, since it is easy to develop materials responsive to various light sources inclusive of visible light to infrared light, can choose a material exhibiting no environmental pollution and is also low in production cost. Further, an organic photoconductor is also superior in electrostatic-charging property and potential retention property, which is advantageous for high-precision and high resolution required in recent digitization.

However, an electrophotographic photoreceptor, which is directly subject to external electrical or mechanical forces in the processes of electrostatic-charging, exposure to light, development, transfer and cleaning, is required to be durable, capable of maintaining charge stability, potential retention, and the like.

Specifically, in the recent trend of digitization, requirements for images of high-precision and high image quality are increased, and a small-particulate toner produced by a process of polymerization, such as a solution suspension toner or an emulsion polymerization coagulation toner, becomes mainstream. Such a small-particulate toner exhibits enhanced adhesion to the photoreceptor surface, producing problems such as insufficient removal of residual toner adhered to the photoreceptor surface after completing the transfer step. A broadly available cleaning system by using a rubber blade (which is hereinafter also denoted as blade-cleaning system) often causes phenomena such as "toner slippage" in which toner particles pass under the blade, "blade torsion" in which a blade is reversed, and occurrence of frictional noise between the photoreceptor and the blade, so-called "blade noise". To overcome the foregoing "toner slippage", it is required to increase the contact pressure of the blade against the photoreceptor but its repeated use produces problems such that, specifically in an organic photoreceptor, the surface is abraded, resulting in deteriorated charging performance. There was also required sufficient durability to deterioration due to ozone or nitrogen oxide produced at the time of charging but a problem regarding this phenomenon arose specifically in organic photoreceptors.

Based on the foregoing background, there was proposed a technique of providing a surface layer on the photoreceptor surface to achieve enhanced mechanical strength. Specifically, there was proposed a technique of preparing a photoreceptor of enhanced durability to counter the surface abrasion or flaws due to friction by a cleaning blade, in which a compound (monomer), also generally called a polymerizable compound, was coated onto the surface layer of a photoreceptor, as described in, for example, JP 2009-080401A and JP 2009-069241A.

There was also proposed a technique in which inorganic particles such as silica were dispersed onto the surface layer to achieve enhanced mechanical strength, as described in, for example, JP 2009-069541A and JP 2002-333733A.

The foregoing prior art achieved enhanced hardness of the photoreceptor surface with a polymerizable compound to attain enhanced resistance to flaws and abrasion to obtain a photoreceptor of enhanced durability. However, there were used commercially available tri- or tetra-functional monomers as a polymerizable compound but they did not sufficiently performed not sufficiently.

To achieve enhanced abrasion resistance of an organic photoreceptor was proposed a photoreceptor which was provided with a curable protective layer formed of a radical-polymerizable compound and a radical-polymerizable compound capable of transporting electrons, as described in JP 2009-251140A. However, the photoreceptor disclosed in JP 2009-251140A introduced a charge transport group, which was also capable of causing steric hindrance in the resin structure of the protective layer, disturbing development of the cross-linking structure, rendering it difficult to achieve sufficient abrasion resistance, and unreacted groups remaining in the protective layer easily causing image blurring.

JP 2009-251140A also described the combined use of a tri-functional radical-polymerizable compound and a penta- or hexa-functional radical-polymerizable compound. However, the combined use of such radical-polymerizable compounds was based on the use of a radical-polymerizable compound exhibiting charge-transporting capability, so that the protective layer formed of such a combined composition did not solve problems including abrasion resistance, flaw resistance, image blurring and the like. Further, when forming a protective layer, the tri-functional radical-polymerizable compound permeates into a lower photosensitive layer, causing cracking of the photosensitive layer; however, there is no description with regard to a preventive measure to permeation into the lower layer.

SUMMARY OF THE INVENTION

As described above, to achieve enhancement of flaw resistance of the photoreceptor surface to perform long operation of the photoreceptor, there was attempted curing with polymerizable compounds to obtain a polymerizable compound exhibiting enhanced hardness after being cured.

In cases where, when forming a surface layer on a photosensitive layer, a coating solution for the surface layer contains a polymerizable compound with low molecular weight and low viscosity, as typified by a commercially available tri-functional methacrylate monomer, the polymerizable monomer permeates to the photosensitive layer and gets entangled in the structure of the resins. When repeatedly performing image formation in such a state, mechanical and electric stresses are applied to a photoreceptor, the polymerizable compound which has permeated the photosensitive layer hinders the interaction between resins of the photosensitive layer or the interaction between a resin and a charge transport material.

Resultingly, a surface layer using a polymerizable compound with a low molecular weight and a low viscosity produces a factor causing cracking of the photosensitive layer. In view of such circumstances, there has been desired a polymerizable compound not causing such cracking of the photosensitive layer.

Accordingly, it is an object of the present invention to provide an electrophotographic photoreceptor which is excellent in flaw resistance, abrasion resistance and crack resistance and exhibits enhanced durability.

One aspect of the present invention is directed to:

(1) An electrophotographic photoreceptor comprising, on an electrically conductive substrate, at least a photosensitive layer and a surface layer provided sequentially in this order, wherein the surface layer is formed by polymerizing a polymerizable compound containing seven to ten functional groups and exhibiting not more than 140 and not less than 100 a reactive group equivalent (that is defined as molecular weight/number of functional groups) of not more than 140 and not less than 100.

(2) The electrophotographic photoreceptor described above, wherein the polymerizable compound is a polymerizable monomer or a polymerizable oligomer containing an acryloyloxy group or a methacryloyloxy group in the structure.

(3) The electrophotographic photoreceptor described above, wherein the surface layer contains metal oxide particles.

(4) The electrophotographic photoreceptor described above, wherein the metal oxide particles are alumina particles, tin oxide particles or titanium oxide particles and those which have been subjected to a surface treatment with a surface treatment agent.

(5) The electrophotographic photoreceptor described above, wherein the surface treatment agent is a compound containing an acryloyloxy group or a methacryloyloxy group.

Another aspect of the present invention is directed to a preparation method of an electrophotographic photoreceptor comprising, on an electrically conductive substrate, at least a photosensitive layer and a surface layer provided sequentially in this order, the method comprising:

forming the surface layer by polymerizing a polymerizable compound containing seven to ten functional groups and exhibiting a reactive group equivalent of not more than 140 and not less than 100.

An electrophotographic photoreceptor which is excellent in flaw resistance, abrasion resistance and crack resistance and exhibits enhanced durability, can be provided according to the present invention.

Figure 1:
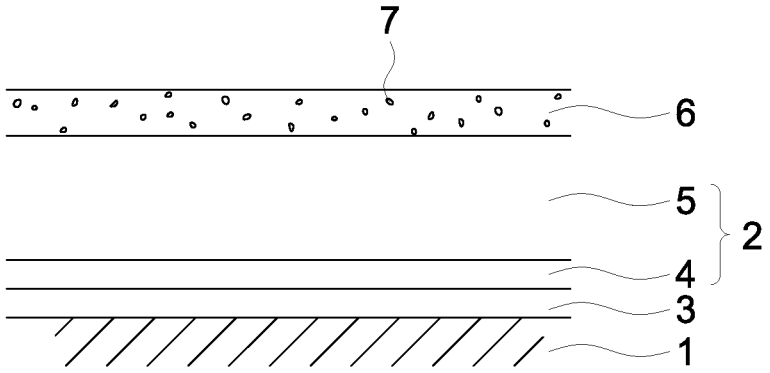
FIG. 1 schematically shows an example of the layer arrangement of a photoreceptor related to the present invention.

There were conventionally used, as a polymerizable compound, monomers containing three or four functional groups in the molecule.

The inventors of the present invention attempted synthesis of an eight or more functional methacryl monomer by using tripentaerythritol or the like as a raw material and introduction of such a polyfunctional monomer to the surface layer of a photoreceptor to achieve further enhanced abrasion resistance and crack resistance. However, it was proved that too many functional groups tended to leave unreacted groups when performing curing, leading to insufficient hardness after being cured. Namely, it was found that the object of the invention was not achieved simply by increasing the number of such reactive groups in the monomer molecule, an optimal is essential number of reactive groups and it was necessary to optimize its ratio in the molecule, that is, a reactive group equivalent to determine the optimum range.

Namely, in the present invention, the surface layer was formed by subjecting a composition comprising a polymerizable compound to polymerization, and the polymerizable compound containing seven to ten functional groups and exhibiting a reactive group equivalent (that is defined as molecular weight/number of functional groups) of not more than 140 and not less than 100. Specifically, setting the appropriate upper and lower limits of the reactive group equivalent and the range of number of reactive groups could define a group of monomers which exhibit a high hardness after being cured. The use of monomers having a large number of functional groups and a high molecular weight inhibited permeation of a monomer into a photosensitive layer before being cured. Accordingly, it was found that cracking of the photosensitive layer when printing repeatedly could be prevented and, in a photoreceptor which was provided with a protective layer on the photosensitive layer, cracking due to a polymerizable compound was also prevented.

The reason for attainment of the effects of the present invention can be inferred from the following.

On the surface layer of a photoreceptor, curing of a polymerizable monomer results in enhanced hardness of the surface of a photoreceptor, leading to enhanced strength of the photoreceptor, so that a monomer which forms a small network of the steric net structure after being cured results in enhanced strength after being cured. Accordingly, as a monomer is required a polyfunctional monomer which has not too large a molecular weight and contains many reactive points. The monomer used in the present invention contains a number of functional groups and is small in reactive group equivalent, as defined by molecular weight divided by the number of functional groups, so that the steric network structure after being cured becomes dense and can result in a photoreceptor exhibiting enhanced strength. However, when the number of functional groups is excessively large, reactive groups tends to remain unreacted or the reactive group equivalent becomes larger along with an increase of the molecular weight of a polymerizable compound so that the cross-linking density becomes coarse, and these do not result in desirable effects. Therefore, the number of functional groups is desirably from 7 to 10. Further, there is desirable a monomer molecule which is in a form of the number of functional groups being large and the reactive group equivalent being relatively small, and which has a certain level of molecular weight. When forming a surface layer using such a monomer molecule on the photosensitive layer, the monomer is difficult to have it enter the photosensitive layer. This has led to a markedly decrease of cracking of the photosensitive layer when performing repeated image formation.

Hereinafter, the embodiments of the present invention will be specifically described but are by no means limited to these.

The electrophotographic photoreceptor of the present invention comprises, on an electrically conductive substrate (also denoted as an electrically conductive support), a photosensitive layer and a surface layer provided sequentially in this order, the surface layer is obtained by coating a coating solution containing a polymerizable compound on the photosensitive layer, followed by subjecting the polymerizable compound to exposure to actinic rays such as light or an electron beam to perform a curing reaction.

The photoelectric photoreceptor of the present invention is comprised of the foregoing constitution, enabling to obtain a surface layer having the intended and uniform thickness and exhibiting an extremely high layer strength and rendering it feasible to obtain a highly durable photoreceptor which can produce images of high quality from the initial stage and can also result in high quality images repeatedly over a long period of time.

Polymerizable Compound:

In the present invention, the surface layer is a layer which was formed by a process of allowing a polymerizable compound containing not less than seven and not more than ten functional groups (preferably, seven or eight functional groups) and exhibiting a reactive group equivalent of not more than 140 and not less than 100 to be polymerized. The polymerizable compound is not specifically limited but preferably, a polymerizable compound containing either an acryloyloxy group or a methacryloyloxy group in the structure, and more preferably, a polymerizable compound containing a methacryloyloxy group. Thereby, the surface layer achieves an enhanced cross-linking density thereof, leading to enhancements of moisture resistance, flaw resistance and abrasion resistance.

In the present invention, there may be mixedly used two or more polymerizable compounds which are different in number of acryloyloxy groups or methacryloyloxy groups.

Polymerizable compounds usable in the present invention preferably are those which are capable of polymerizing upon exposure to an actinic ray such as light or an electron beam. Such polymerizable compounds can be polymerized to be cured at a small amount of light or over a short period of time.

In the present invention, an acryloyloxy group or methacryloyloxy group is as follows:

Acryloyloxy group: $CH_2{=}CHCOO{-}$

Methacryloyloxy group: $CH_2{=}CCH_3COO{-}$

Specific examples of a polymerizable compound usable in the present invention are shown below but polymerizable compounds usable in the present invention are not limited to these.

In the following examples, numerals enclosed within parentheses represent (Ac group number reactive group equivalent). The Ac group number (acryloyl group number) represents the number of acryloyl groups or methacryloyl groups and the reactive group equivalent represents a ratio of molecular weight to number of acryloyl groups or methacryloyl groups. Compounds M-1 to M-3, M-6, M-11 and M-12 are polymerizable compounds related to the invention, which.

M-1(8•115)

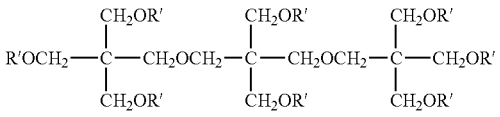

M-2(7•121)

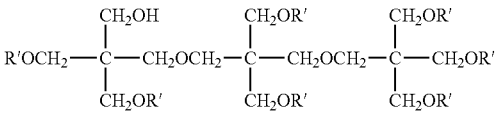

M-3(8•101)

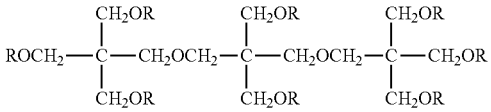

M-4(3•99)

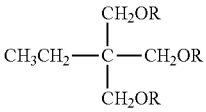

M-5(3•113)

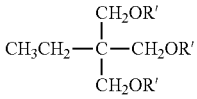

M-6(10•117)

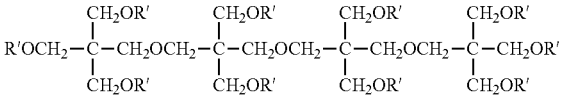

M-7(12•119)

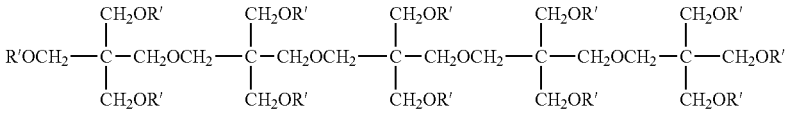

M-8(7•155)

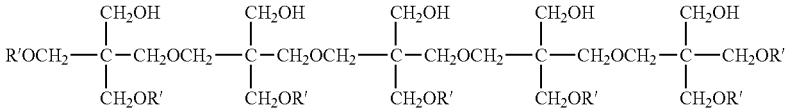

M-9(6•127)

$(ROCH_2)_3CCH_2OCONH(CH_2)_6NHCOOCH_2C(CH_2OR)_3$

M-10(8•94)

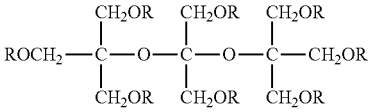

M-11(7•138)

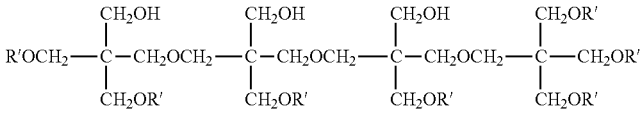

M-12(9•122)

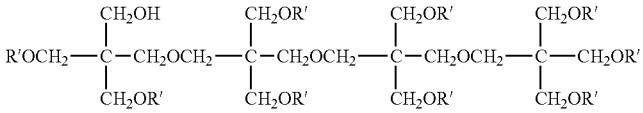

In the foregoing exemplified compounds, designations, R and R' represent the following structures, respectively.

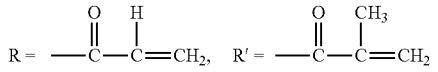

The foregoing polymerizable compounds can be synthesized in the following manner, as exemplified by compounds M-1 and M-2.

Into a reactor vessel were added 100 g of tripentaerythritol, 162 g of methacrylic acid, 91 g of cyclohexane, 8.0 g of sulfuric acid and 1.2 g of hydroquinone monomethyl ether and reacted at a temperature of 80 to 90° C. for 8 hours, while blowing air through the mixture at a rate of 10 ml/min. After completing the reaction, 530 g of toluene was added to the reaction mixture and the obtained organic layer was washed with an aqueous 25% by mass sodium hydroxide solution and subsequently washed with an aqueous 10% by mass sodium sulfate and dried by using magnesium sulfate; then, 0.2 g of a polymerization inhibitor (hydroquinone monomethyl ether) was added thereto, and condensed and dried to obtain 183 g of tripentaerythritol poly(meth)acrylate. The thus obtained tripentaerythritol poly(meth)acrylate was in the form of a mixture of tripentaerythritol hexa(meth)acrylate, tripentaerythritol hepta(meth)acrylate and tripentaerythritol octa(meth) acrylate, each of which was fractionated through distillation to obtain the respective monomers.

In addition to the foregoing polymerizable monomers, there may be used various polymerizable oligomers. Specific examples of such polymerizable oligomers include an epoxy methacrylate oligomer, a urethane methacrylate oligomer, a polyester methacrylate oligomer and the like.

In one of the preferred embodiments of the present invention, the surface layer is formed by polymerizing the composition comprising a polymerizable compound exhibiting a viscosity of 30 to 3000 mPa·s at 25° C., together with the above-described polymerizable compound containing not less than seven and not more than ten functional groups and exhibiting a reactive group equivalent of not more than 140 and not less than 100. Such a polymerizable compound exhibiting a viscosity of 30 to 300 mPa·s at 25° C. is preferably a di- to tetra-functional acrylate or methacrylate, that is, a compound containing two to four acrylate groups or a compound containing two to four methacrylate groups and examples of such a compound include trimethylolpropane trimethacrylate (viscosity: 44 mPa·s), trimethylolpropane triacrylate (viscosity: 110 mPa·s), pentaerythritol tetraacrylate (viscosity: 342 mPa·s), ethoxylated bisphenol A dimethacrylate (viscosity: 700 mPa·s), and tricyclodecanedimethanol diacrylate (viscosity: 130 mPa·s).

The polymerizable compound exhibiting a viscosity of 30 to 300 mPa·s at 25° C. can be readily synthesized according to the method known in the art and is also commercially available.

As described above, the composition to form the surface layer is allowed to include a polymerizable compound exhibiting a viscosity of 30 to 300 mPa·s at 25° C. together with the polymerizable compound containing not less than seven and not more than ten functional groups and the composition is subjected to chain polymerization to form the surface layer.

The viscosity of a polymerizable compound exhibiting a viscosity of 30 to 300 mPa·s at 25° C. is determined by a rotational viscometer (VISCINIC ELD-type, made by Tokyo Keiki Co., Ltd.), while circulating water of a constant-temperature bath maintained at 25° C.

In cases when coating, on the photosensitive layer, a surface layer composition exhibiting a viscosity of not less than 30 mPa·s at 25° C., permeation of the foregoing di- to tetra-functional acrylate or methacrylate to the photosensitive layer is retarded, preventing the photosensitive layer from cracking. Further, in cases of a viscosity of not more than 3000 mPa·s, a polymerization reaction with the compound containing not less than seven functional groups is maintained, preventing the surface layer from deterioration in abrasion resistance and crack resistance.

Metal Oxide Particle:

In one preferred embodiment of the present invention, the surface layer contains metal oxide particles as needed. Any particulate metal oxide is usable, including transition metals. Examples of such a metal oxide include silica (silicon oxide), magnesium oxide, zinc oxide, lead oxide, alumina (aluminum oxide), tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide, and vanadium oxide, of which alumina, tin oxide or titanium oxide is preferred.

The number average primary particle size of the forgoing metal oxide is preferably within a range of from 1 to 300 nm and more preferably from 3 to 100 nm.

The number average primary particle size of the foregoing metal oxide particles can be determined in such a manner that macrophotographs are taken by using a scanning electron microscope (produced by Nippon Denshi Co., Ltd.) at a 10,000-fold magnification and photographic images in which 300 particles (excluding aggregated particles) are randomly incorporated by a scanner are subjected to processing by using an automatic image processing analyzer (LUZEX AP, produced by NIRECO Co., Ltd.) and a software version Ver. 1.32 to calculate the number average primary particle size.

The content of the foregoing metal oxide particles is preferably from 20 to 400% by mass, and more preferably from 50 to 300% by mass.

A particulate metal oxide content of not less than 20% by mass depresses an excessive increase of electric resistance of the surface layer, leading to prevention of an increase of residual potential or occurrence of fogging; a metal oxide content of not more than 400% by mass results in improved film-forming property, leading to prevention of lowering of electrostatic-charging capability or generation of pin holes.

The metal oxide particles related to the present invention exhibit advantageous effects even when not subjected to a surface treatment but a surface treatment with a surface treatment agent containing a reactive organic group preferably results in enhanced bonding to a polymerizable compound.

Next, there will be described a surface treatment agent used for the surface treatment of metal oxide particles.

A surface treatment agent used for the surface treatment of metal oxide particles can employ any one which exhibits reactivity with a hydroxyl group or the like, existing on the metal oxide particle surface. Surface treatment agents exhibiting such reactivity include, for example, compounds described below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$

S-10:$CH_2{=}CHCOO(CH_2)_3Si(CH_3)Cl_2$
S-11:$CH_2{=}CHCOO(CH_2)_3SiCl_3$
S-12:$CH_2{=}C(CH_3)COO(CH_2)_2Si(CH_3)(OCH_3)_2$
S-13:$CH_2{=}C(CH_3)COO(CH_2)_2Si(OCH_3)_3$
S-14:$CH_2{=}C(CH_3)COO(CH_2)_3Si(CH_3)(OCH_3)_2$
S-15:$CH_2{=}C(CH_3)COO(CH_2)_3Si(OCH_3)_3$
S-16:$CH_2{=}C(CH_3)COO(CH_2)_2Si(CH_3)Cl_2$
S-17:$CH_2{=}C(CH_3)COO(CH_2)_2SiCl_3$
S-18:$CH_2{=}C(CH_3)COO(CH_2)_3Si(CH_3)Cl_2$
S-19:$CH_2{=}C(CH_3)COO(CH_2)_3SiCl_3$
S-20:$CH_2{=}CHSi(C_2H_5)(OCH_3)_2$
S-21:$CH_2{=}C(CH_3)Si(OCH_3)_3$
S-22:$CH_2{=}C(CH_3)Si(OC_2H_5)_3$
S-23:$CH_2{=}CHSi(OCH_3)_3$
S-24:$CH_2{=}C(CH_3)Si(CH_3)(OCH_3)_2$
S-25:$CH_2{=}CHSi(CH_3)Cl_2$
S-26:$CH_2{=}CHCOOSi(OCH_3)_3$
S-27:$CH_2{=}CHCOOSi(OC_2H_5)_3$
S-28:$CH_2C(CH_3)COOSi(OCH_3)_3$
S-29:$CH_2{=}C(CH_3)COOSi(OC_2H_5)_3$
S-30:$CH_2{=}C(CH_3)COO(CH_2)_3Si(OC_2H_5)_3$
S-31:$CH_2{=}CHCOO(CH_2)_2Si(CH_3)_2(OCH_3)$
S-32:$CH_2HCOO(CH_2)_2Si(CH_3)(OCOCH_3)_2$
S-33:$CH_2HCOO(CH_2)_2Si(CH_3)(ONHCH_3)_2$
S-34:$CH_2HCOO(CH_2)_2Si(CH_3)(OC_6H_5)_2$
S-35:$CH_2{=}CHCOO(CH_2)_2Si(C_{10}H_{21})(OCH_3)_2$
S-36:$CH_2{=}CHCOO(CH_2)_2Si(CH_2C_6H_5)(OCH_3)_2$

There may be used silane compounds containing a reactive organic group capable of radical-polymerization, other than the foregoing surface treatment agents S-1 to S-36. Specifically, a silane compound containing an acryloyl group or methacryloyl group is preferred.

The foregoing surface treatment agents can be used singly or in their combination.

Preparation of Surface-Treated Metal Oxide Particles:

A surface treatment is conducted preferably by using a surface treatment agent in an amount of 0.1 to 100 parts by mass, based on 100 parts by mass of particles together with 50 to 5000 parts by mass of a solvent in a wet-type media dispersion type apparatus. A dry treatment can also be conducted.

In the following, there will be described a surface treatment method for preparing metal oxide particles which have homogeneously been surface-treated with a surface treatment agent.

A slurry containing metal oxide particles and a surface treatment agent (that is, suspension of solid particles) are wet-ground to be fined, while promoting a surface treatment of the particles. Subsequently, the solvent is removed therefrom to enable powdering to obtain metal oxide particles which have been homogeneously treated with the surface treatment agent.

The wet-type media dispersion type apparatus as a surface treatment apparatus is an apparatus having a step in which beads as media are placed into a vessel, and a stirring disc provided vertically to a rotation shaft is rotated to grind aggregated metal oxide particles and to disperse them. The constitution thereof may be no problem in which metal oxide particles can be sufficiently dispersed and surface-treated at the time when performing a surface treatment of the metal oxide particles, and can employ various types, such as a vertical type, a horizontal type, a continuation type and a batch type. Specifically, there can be employed a sand mill, an ultravisco mill, a pearl mill, a grain mill, DYNO-MILL, an agitator mill, a dynamic mill and the like. These dispersing type apparatuses perform fine-grinding and dispersion through impact crushing, friction, shearing, shear stress or the like, while using a grinding media such as balls, beads or the like.

Beads used in the foregoing wet media dispersion type apparatuses can employ balls made from glass, alumina, zircon, zirconia, steel, flint or the like, and those made from zirconia or zircon are preferable. The bead size is employed usually in the range of approximately 1-2 mm in diameter, but approximately 0.1-1.0 mm is preferably employed in the present invention.

Various materials, such as stainless steel, nylon and ceramic are usable for a disc or the internal wall of a vessel used in a wet-type media dispersing apparatus, and a disc or an internal vessel wall made of a ceramic such as zirconia or silicon carbide is preferably used in the present invention.

There can be obtained metal oxide particles containing an organic reactive group capable of reacting with a reactive acryloyl group or a reactive methacryloyl group through a surface treatment using a surface treatment agent by a wet process, as described above.

The surface layer related to the present invention can be formed by use of a commonly known resin in combination with a compound obtained through reaction.

Examples of such a commonly known resin include a polyester resin, a polycarbonate resin, a polyurethane resin, an acryl resin, an epoxy resin, a silicone resin and an alkyd resin.

The surface layer related to the present invention may be formed by containing a polymerization initiator, a filler, a particulate lubricant or the like, as needed.

Polymerization Initiator:

In the present invention, a polymerizable compound is subjected to a curing reaction to form a surface layer. Such a curing reaction can be performed by a technique of employing an electron beam cleavage reaction or a technique of employing a radical polymerization initiator in the presence of light or heat. In cases when performing a curing reaction by using a radical polymerization initiator, the polymerization initiator can employ both a photopolymerization initiator and a heat polymerization initiator. There may be employed a photopolymerization initiator and a heat polymerization initiator in combination.

Specific examples of a polymerization initiator include an acetophenone or ketal type photopolymerization initiator such as diethoxyacetophenone, 2,2-dimethoxy-1,2-diphenylethane-1-one, 1-hydroxycyclohexyl-phenyl-ketone, 4-(2-hydroxyethoxy)phenyl-(2-hydroxy-2-propyl)ketone, 2-benzyl-2-dimethylamino-1-(4-morpholinophenyl)butane-1 (IRGACURE 369, produced by Ciba Japan Co.), 2-hydroxy-2-methyl-1-phenylpropane-1-one, 2-methyl-2-morpholino (4-methylthiophenyl)propane-1-one, and 1-phenyl-1,2-propanedione-2-(o-ethoxycarbonyl)oxime; a benzoin ether type photopolymerization initiator such as benzoin, benzoin methyl ether, benzoin ethyl ether, benzoin isobutyl ether and benzoin isopropyl ether, a benzophenone type photopolymerization initiator such as benzophenone, 4-hydroxybenzophenone, methyl o-benzoylbenzoate, 2-benzoyl naphthalene, 4-benzoyl biphenyl, 4-benzoyl phenyl ether, acrylated benzophenone, and 1,4-benzoylbenzene; and a thioxanthone type photopolymerization initiator such as 2-isopropylthixanthone, 2-chlorothioxanthone, 2,4-dimethylthioxanthone, 2,4-diethylthioxanthone and 2,4-dichlorothioxanthone.

Other photopolymerization initiators include, for example, ethylanthraquinone, 2,4,6-trimethylbenzoyl-di-phenylphosphine oxide, 2,4,6-trimethylbenzoylphenylethoxyphosphine oxide, bis(2,4,6-trimethylbenzoyl)phenylphosphine oxide (IRGACURE 819, produced by Ciba Japan Co.), bis(2,4-dimethoxybenzoyl)-2,4,4-trimethylpentylphosphine oxide, methyl phenylglyoxylic acid ester, 9,10-phenathorene, acridine compounds, triazine compounds and imidazole compounds. A reagent for accelerating photopolymerization may be used singly or in combination with the foregoing polymerization initiator. Examples thereof include triethanolamine, methydiethanolamine, ethyl 4-dimethylamonobezoate, isoamyl 4-dimethylaminobenzoate, ethyl (2-dimethylamino) benzoate, and 4,4'-dimethylaminobenzophenone.

A polymerization initiator usable in the present invention preferably is a photopolymerization initiator, in which an alkylphenone compound and a phosphine oxide are preferred, and an initiator having an α-hydroxyacetophenone structure or acylphosphine oxide structure is more preferred.

These polymerization initiators may be used singly or in their combination. The content of a polymerization initiator is preferably from 0.1 to 40 parts by mass, based on 100 parts by mass of a polymerizable compound, and more preferably from 0.5 to 20 Parts by mass.

Particulate Lubricant:

Various kinds of particulate lubricants may be contained in the surface layer. For instance, there may be incorporated fluorine-containing resin particles. Examples of such a fluorine-containing resin include tetrafluoroethylene, trifluorochloroethylene, haxafluorochloroethylene-propylene resin, fluorovinyl resin, fluorovinilidene resin, difluorodichloroethylene resin and their copolymeric resins. It is preferred to choose one or more of these resins, and a tetrafluoroethylene resin or a fluorovinylidene resin is specifically preferred.

Solvent:

Examples of a solvent used for formation of the surface layer methanol, ethanol, n-propyl alcohol, isopropyl alcohol, n-butanol, t-butanol, sec-butanol, benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine and diethylamine, but are not limited to these.

Formation of Surface Layer:

The surface layer can be formed in such a manner that a coating solution prepared by addition of a polymerizable compound, surface-treated metal oxide particles, a commonly known resin as needed, a polymerization initiator, a particulate lubricant, an antioxidant and the like, is coated on the surface of the photosensitive layer by a commonly known method and naturally or thermally dried, and then cured.

Coating methods usable in the present invention include commonly known coating methods such as a dip coating method and a circular quantity control coating method, of which the circular quantity control coating method is preferred.

The thickness of a surface layer is preferably rom 0.2 to 10 μm, and more preferably 0.5 to 6 μm.

In the present invention, the surface layer is cured preferably in the manner that a coated layer is exposed to an actinic ray to generate radicals to perform polymerization with forming curing bonds through intermolecular and intramolecular curing reactions, whereby a cured resin is formed. The actinic ray preferably is light such as ultraviolet or visible light, or electron beams.

An ultraviolet light source may employ any one which generates ultraviolet rays, and examples thereof include a low pressure mercury lamp, a medium pressure mercury lamp, a high pressure mercury lamp, an ultra-high pressure mercury lamp, a carbon arc lamp, a metal halide lamp, a xenon, a flash (pulse) xenon, and an ultraviolet LED. Exposure conditions depend on the individual lamps, and the exposure amount to an actinic ray is preferably 1 to 20 mJ/cm$^2$, and more preferably from 5 to 15 mJ/cm$^2$. The output voltage of a light source is preferably from 0.1 to 5 kW, and more preferably from 0.5 to 3 kW.

An ultraviolet ray source can employ any light source capable of emitting ultraviolet rays. Examples thereof include a low pressure mercury lamp, a medium pressure mercury lamp, a high pressure mercury lamp, an ultra-high pressure mercury lamp, a carbon arc lamp, a metal halide lamp, a xenon lamp, a flash (pulse) lamp and an ultraviolet LED lamp. The exposure condition depends on the respective lamp and the actinic ray exposure amount is preferably from 1 to 20 mJ/cm$^2$, and more preferably from 5 to 15 mJ/cm$^2$. The output voltage of a light source is preferably from 0.1 to 5 kW, and more preferably from 0.5 to 3 kW.

The electron beam exposure apparatus as an electron beam source is not specifically limited and an electron beam accelerator used for exposure to an electron beam can effectively employ a curtain beam system which can achieve a high output at a relatively low cost. The acceleration voltage when performing exposure to an electron beam is preferably from 100 to 300 kV. The absorption dose is preferably from 0.005 Gy to 100 kGy (0.5 to 10 Mrad).

The exposure time to an actinic ray, which is the time required to obtain the necessary exposure amount, is preferably from 0.1 sec. to 10 minutes, and more preferably from 1 sec. to 5 minutes in terms of curing efficiency or working efficiency.

In the present invention, the surface layer can be dried before or after exposure to actinic rays, or during exposure to an actinic ray. The timing of performing drying can appropriately be chosen in combination with the exposure condition to actinic rays. The drying condition of the surface layer can appropriately be chosen according to the kind of solvent used for the coating solution or the thickness of the surface layer. The drying temperature is preferably from room temperature to 180° C., and more preferably 80 to 140° C. The drying time is preferably from 1 to 200 minutes and more preferably from 5 to 100 minutes.

Layer Arrangement of Photoreceptor:

The photoreceptor of the present invention is formed of, on an electrically conductive substrate, a photosensitive layer and a surface layer. The photosensitive layer does not restrict the layer arrangement and Specific examples of the layer arrangement including a surface layer are as below:

(1) A layer arrangement comprising, on an electrically conductive substrate, a charge generation layer, a charge transport layer and a surface layer provided sequentially in that order;

(2) A layer arrangement comprising, on an electrically conductive substrate, a single layer containing a charge generation material and a charge transport material, and a surface layer provided sequentially in that order;

(3) A layer arrangement comprising, on an electrically conductive substrate, an intermediate layer, a charge generation layer, a charge transport layer and a surface layer provided sequentially in that order; and (4) A layer arrangement comprising, on an electrically conductive substrate, an intermediate layer, a single layer containing a charge generation material and a charge transport material, and a surface layer provided sequentially in that order.

The photoreceptor of the present invention may be any one of the foregoing (1) to (4) and of these, the layer arrangement comprising, on an electrically conductive substrate, an intermediate layer, a charge generation layer, a charge transport layer and a surface layer provided sequentially in that order is specifically preferred.

FIG. 1 illustrates an example of the layer arrangement of the photoreceptor of the present invention.

In FIG. 1, the numeral 1 designates an electrically conductive substrate; the numeral 2, a photosensitive layer; the numeral 3, an intermediate layer, the numeral 4, a charge generation layer; the numeral 5, a charge transport layer; the numeral 6, a surface layer; and the numeral 7, a metal oxide particle.

In the following, there will be described an electrically conductive substrate and a photosensitive layer (including an intermediate layer, a charge generation layer and a charge transport layer), and members constituting the photosensitive layer.

Conductive Substrate:

A substrate usable in the present invention may be any electrically conductive one, and examples thereof include a metallic drum or sheet formed of aluminum, copper, chromium, nickel, zinc or stainless steel; a metallic foil of aluminum or copper, laminated with plastic film; aluminum, indium oxide or tin oxide, deposited on plastic film; a metal provided with an electrically conductive layer which is formed by coating an electrically conductive material singly or in combination with a binder resin; and plastic film or paper.

Intermediate Layer:

In the present invention, an intermediate layer having a barrier function and an adhesion function may be provided between the electrically conductive substrate and the photosensitive layer. The intermediate layer can be formed by coating, through dip coating or the like, a binder resin such as casein, polyvinyl alcohol, nitrocellulose, an ethylene-acrylic acid copolymer resin, a polyamide, a polyurethane, or gelatin, which has been dissolved in a conventional solvent. Of the foregoing binder resins is preferred an alcohol-soluble polyamide resin.

The intermediate layer may contain various kinds of electrically conductive particles or particulate metal oxides, including, for example, particulate metal oxides such as alumina, zinc oxide, titanium oxide, tin oxide, antimony oxide, indium oxide, or bismuth oxide; and ultra-fine particles of tin-doped indium oxide, antimony-doped tin oxide or zirconium oxide. These particulate metal oxides may be used singly or in their combination. In cases when used in combination, they may be in the form of a solid solution or fusion. Such metal oxide particles preferably exhibit a number average primary particle size of not more than 0.3 μm and more preferably not more than 0.1 μm.

A solvent usable for formation of an intermediate layer is preferably one which is capable of dispersing inorganic particles such as electrically conductive particles or metal oxide particles and is also capable of dissolving a binder resin such as a polyimide resin. Specific examples thereof include alcohols with 2-4 carbons, such as ethanol, n-propyl alcohol, iso-propyl alcohol, n-butanol, t-butanol, or sec-butanol are preferred, which are superior in solution and coating performance of a polyimide resin. Auxiliary solvents which are used in combination with the foregoing solvents and effective to achieve enhanced dispersibility, include methanol, benzyl alcohol, toluene, methylene chloride, cyclohexane, and tetrahydrofuran.

The binder resin concentration is appropriately chosen to meet the thickness or production speed of the intermediate layer. When dispersing inorganic particles in a binder resin, the mixing ratio of inorganic particles to a binder resin is preferably 20 to 400 parts by mass, based on 100 parts of a binder resin, and more preferably 50 to 200 parts by mass.

Means for dispersing inorganic particles include, for example, an ultrasonic dispersing machine, a ball mill, a sand grinder, a homo-mixer and the like, but are not limited to these.

The drying method of an intermediate layer is appropriately chosen from methods known in the art in accordance with the kind of a solvent or layer thickness, but thermal drying is preferred.

The thickness of the intermediate layer is preferably from 0.1 to 15 μm, and more preferably from 0.3 to 10 μm.

Photosensitive Layer.

As described earlier, a photosensitive layer constituting the photoreceptor of the present invention preferably has a layer structure in which the function of the photosensitive layer is separated to a charge generation layer (CGL) and a charge transport layer (CTL), as compared to a single layer structure in which a charge generation function and a charge transport function are provided to a single layer. Such a layer constitution of a function separation type can not only control the increase of residual potential along with repeated use but also has the advantage of electrophotographic characteristics being easily controlled in accordance with the object. A negative-charging photoreceptor is provided with, on an intermediate layer, a charge generation layer (CGL) and further thereon a charge transport layer (CTL); and a positive-charging photoreceptor is provided with, on an intermediate layer, a charge transport layer (CTL) and further thereon a charge generation layer (CGL). A preferable layer constitution of the photosensitive layer is a negative-charging photoreceptor having the foregoing function separation structure.

In the following, there will be described, as a specific example of a photosensitive layer, the individual layers of a function separation type negative-charging photoreceptor.

Charge Generation Layer:

The charge generation layer used in the present invention contains a charge generation material and a binder, and the charge generation layer is formed preferably by coating a solution of the charge generation material dispersed in a binder resin solution.

Examples of a charge generation material include an azo pigment, such as Sudan Red or Dian Blue, a quinine pigment such as pyrenequinone or anthanthrone, a quinocyanine pigment, a perylene pigment, an indigo pigment such as indigo or thioindigo, and a phthalocyanine pigment, but are not limited to these. Such a charge generation material may be used alone or in the form of being dispersed in a resin known in the art.

A binder resin of the charge generation layer may employ a resin known in the art and examples thereof include a polystyrene resin, a polyethylene resin, a polypropylene resin, an acryl resin, a methacryl resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin a melamine resin, and a copolymer resin comprising at least two of the foregoing resins (for example, vinyl chloride/vinyl acetate copolymer resin, vinyl chloride/vinyl acetate/maleic acid anhydride copolymer resin), and polyvinyl carbazole resin, but are not limited to these.

Preferably, a charge generation layer is formed in the manner that a charge generation material is dispersed in a solution of a binder resin dissolved in a solvent to prepare a coating solution, the coating solution is coated at a given thickness by a coating machine and the coated layer is dried.

Examples of a solvent to dissolve the binder resin used for a charge generation layer include toluene, xylene, methylene chloride, 1,2-dichloroethane, methyl ethyl ketone, cyclohexane, ethyl acetate, methanol, ethanol, propanol, butanol, methyl cellosolve, ethyl cellosolve, tetrahydrofuran, 1-dioxane, 1,3-dioxorane, pyridine and diethylamine, but are not limited to these.

The dispersing means for a charge generation material include, for example, an ultrasonic dispersing machine, a ball mill, a sand grinder and a homo-mixer, but is not limited to these.

The mixing ratio of charge generation material to binder resin is preferably from 1 to 600 parts by mass of a charge generation material, based on 100 parts by mass of a binder resin, and more preferably from 50 to 500 parts by mass. The thickness of the charge generation layer, depending of characteristics of the charge generation layer, characteristics of a binder resin and a mixing ratio, is preferably from 0.01 to 5 μm, and more preferably from 0.05 to 3 μm. Filtration of a coating solution of a charge generation layer before being coated filters out foreign matter or an aggregate to prevent image defects. A pigment, as described above may be deposited through vacuum deposition to form a charge generation layer.

Charge Transport Layer:

A charge transport layer used in the invention a charge transport material and a binder, and preferably, the charge transport material dispersed in a binder resin solution is coated to form a charge transport layer.

Examples of a charge transport material include a carbazole derivative, an oxazole derivative, an oxadiazole derivative, a thiazole derivative, a thiadiazole derivative, a triazole derivative, an imidazole derivative, an imidazolone derivative, an imidazolidine derivative, a bis-imidazolidine derivative, a styryl derivative, a hydrazone compound, a pyrazoline compound, an oxazolone derivative, a benzimidazole derivative, a quinazoline derivative, a benzofuran derivative, an acridine derivative, a phenazine derivative, an aminostilbene derivative, a thiazoleamine derivative, a phenylenediamine derivative, a stilbene derivative, a benzidine derivative, poly-N-vinylcarbazole, poly-1-vinylpyrene, poly-9-vinylanthracene, and a triphenylamine derivative. These may be used in combination.

A binder resin used for a charge transport layer can employ a resin known in the art. Examples thereof include a polycarbonate resin, a polyacrylate resin, a polyester resin, a polystyrene resin, a styrene-acrylonitrile copolymer resin, a polymethacrylic acid ester resin and a styrene-methacrylic acid ester copolymer resin, and of these, a polycarbonate resin is preferred. Further, polycarbonate resin, such as a type of Bisphenol A (BPA), Bisphenol Z (BPZ), dimethyl-BPA, and BPA-dimethyl-BPA copolymer are preferred in terms of cracking resistance, abrasion resistance and electrostatic-charging characteristic.

A charge transport layer can be formed by a commonly known method, as typified by a coating method. In the coating method, for example, the charge transport layer is formed in the manner that a charge transport material and a binder resin are dissolved in a solvent to prepare a coating solution, the coating solution is coated at a given thickness with a coating machine and the coated layer is dried.

Examples of a solvent used for the solution of the foregoing binder and a charge transport material include toluene, xylene, methylene chloride, 1,2-dichloroethane, methyl ethyl ketone, cyclohexane, ethyl acetate, methanol, ethanol, propanol, butanol, methyl cellosolve, ethyl cellosolve, tetrahydrofuran, 1-dioxane, 1,3-dioxorane, pyridine and diethylamine, but are not limited to these.

The mixing ratio of binder resin to charge transport material is preferably from 10 to 500 parts by mass of the charge generation material, based on 100 parts by mass of the binder resin, and more preferably from 20 to 100 parts by mass.

The thickness of a charge transport layer, depending of the characteristics of the charge transport layer, characteristics of the binder resin and mixing ratio, is preferably from 5 to 40 μm, and more preferably from 10 to 30 μm.

A commonly known antioxidant may be added to the charge transport layer and there are usable antioxidants, as described in, for example, JP 2000-305291A.

Each of the layers constituting the photoreceptor of the present invention, including an intermediate layer, a charge generation layer, a charge transport layer and a surface layer, can be formed by commonly known coating methods. Specific examples thereof include a dip coating method, a spray coating method, a spinner coating method, a bead coating method, a blade coating method, a beam coating method and a circular quantity control type coating method.

Image Forming Apparatus:

In the following, there will be described an image forming apparatus related to the present invention.

An image forming apparatus to attain advantageous effects of the present invention is provided with an electrophotographic photoreceptor comprising at least the surface layer of the present invention, an electrostatic-charging means to charge the surface of the forgoing electrophotographic photoreceptor, an exposure means to expose the photoreceptor surface charged by the electrostatic-charging means to imagewise exposure to form a latent image, a developing means to develop a latent image formed by the imagewise exposure to form a toner image, and a transfer means to transfer the toner image formed on the photoreceptor surface by the developing means to a transfer medium such as paper or a transfer belt.

The charging means to charge the electrophotographic photoreceptor surface preferably employs a non-contact electrostatic charging device. Such a non-contact electrostatic charging device includes, for example, a corona charger, a corotron charger and a scorotron charger.

Figure 2:
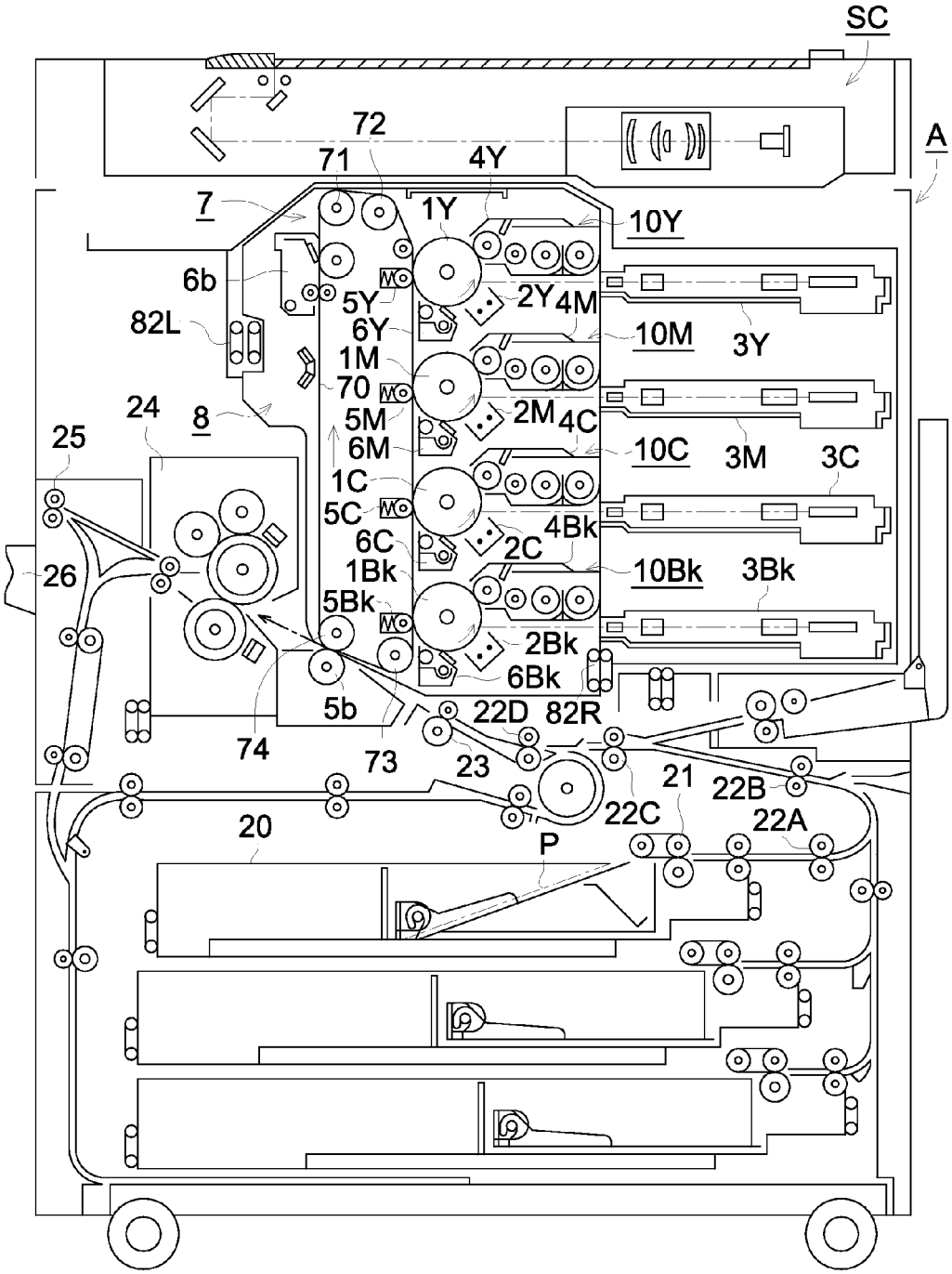
FIG. 2 illustrates a schematic sectional view showing an example of an image forming apparatus using a photoreceptor related to the invention.

FIG. 2 illustrates a sectional view of a color image forming apparatus showing one of the embodiments of the present invention.

This image forming apparatus, which is called a tandem color image forming apparatus, is, as a main constitution, comprised of four image forming sections (image forming units) 10Y, 10M, 10C and 10Bk; an intermediate transfer material unit 7 of an endless belt form, a paper feeding and conveying means 21 and a fixing means 24. Original image reading device SC is disposed in the upper section of image forming apparatus body A.

Image forming section 10Y to form a yellow image comprises a drum-form photoreceptor 1Y as the first photoreceptor, an electrostatic-charging means 2Y (electrostatic-charging step), an exposure means 3Y (exposure step), a developing means 4Y (developing step), a primary transfer roller 5Y (primary transfer step) as a primary transfer means; and a cleaning means 6Y, which are disposed around the photoreceptor 1Y.

An image forming section 10M to form a magenta image comprises a drum-form photoreceptor 1M as the second photoreceptor, an electrostatic-charging means 2M, an exposure means 3M and a developing means 4M, a primary transfer roller 5M as a primary transfer means; and a cleaning means 6M, which are disposed around the photoreceptor 1M.

An image forming section 10C to form a cyan image formed on the respective photoreceptors comprises a drum-form photoreceptor 1C as the third photoreceptor, an electrostatic-charging means 2Y, an exposure means 3C, a developing means 4C, a primary transfer roller 5C as a primary transfer means and a cleaning means 6C, all of which are disposed around the photoreceptor 1C.

An image forming section 10Bk to form a black image formed on the respective photoreceptors comprises a drum-form photoreceptor 1Bk as the fourth photoreceptor, an electrostatic-charging means 2Bk, an exposure means 3Bk, a developing means 4Bk, a primary transfer roller 5Bk as a primary transfer means and a cleaning means 6Bk, which are disposed around the photoreceptor 1Bk.

The foregoing four image forming units 10Y, 10M, 10C and 10Bk are comprised of centrally-located photoreceptor drums 1Y, 1M, 1C and 1Bk; rotating electrostatic-charging means 2Y, 2M, 2C and 2Bk; imagewise exposure means 3Y, 3M, 3C and 3Bk; rotating developing means 4Y, 4M, 4C and 4Bk; and cleaning means 6Y, 6M, 6C and 6Bk for cleaning the photoreceptor drums 1Y, 1M, 1C and 1Bk.

The image forming units 10Y, 10M, 10C and 10Bk are different in color of toner images formed in the respective photoreceptors 1Y, 1M, 1C and 1Bk but are the same in constitution, and, for example, the image forming unit 10Y will be described below.

The image forming unit 10Y disposes, around the photoreceptor 1Y, the electrostatic-charging means 2Y (hereinafter, also denoted as a charging means 2Y or a charger 2Y), the exposure means 3Y, the developing means (developing step) 4Y, and the cleaning means 6Y (also denoted as a cleaner 6Y or a cleaning blade 6Y), and forming a yellow (Y) toner image on the photoreceptor 1Y. In this embodiment, of the image forming unit 10Y, at least the photoreceptor drum unit 1Y, the charging means 2Y, the developing means 4Y and the cleaning means 6Y are integrally provided.

The charging means 2Y is a means for providing a uniform electric potential onto the photoreceptor drum 1Y. In the embodiment, the charger 2Y of a corona discharge type is used for the photoreceptor 1Y.

The imagewise exposure means 3Y is a mean which exposes the photoreceptor drum 1Y having a uniform potential given by the charger 2Y to light, based on (yellow) image signals to form an electrostatic latent image corresponding to the yellow image. As the exposure means 3Y is used one composed of an LED arranging emission elements arrayed in the axial direction of the photoreceptor drum 1Y and an imaging device (trade name: SELFOC lens), or a laser optical system.

In the image forming apparatus relating to the invention, the above-described photoreceptor and constituent elements such as a developing device and a cleaning device may be integrally combined as a process cartridge (image forming unit), which may be freely detachable from the apparatus body. Further, at least one of a charger, an exposure device, a developing device, a transfer or separating device and a cleaning device is integrally supported together with the photoreceptor to form a process cartridge as a single image forming unit which is detachable from the apparatus body by using a guide means such as a rail of the apparatus body.

An intermediate transfer unit 7 of an endless belt form is entrained about plural rollers and has intermediate transfer material 70 as the second image carrier of an endless belt form, while being pivotably supported.

The individual color images formed in the individual image forming sections 10Y, 10M, 10C and 10Bk are successively transferred onto the moving intermediate transfer material (70) of an endless belt form by primary transfer rollers 5Y, 5M, 5C and 5Bk, respectively, to form a composite color image Recording member P of paper or the like, as a final transfer material housed in a paper feed cassette 20, is fed by paper feed and a conveyance means 21 and conveyed to a secondary transfer roller 5*b* through plural intermediate rollers 22A, 22B, 22C and 22D and a resist roller 23, and color images are secondarily transferred together on a transfer material P. The transfer material (P) to which the color image has been transferred is fixed by a heat-roll type fixing device 24, nipped by a paper discharge roller 25 and put onto a paper discharge tray 26 outside a machine. Herein, a transfer support of a toner image formed on the photoreceptor, such as an intermediate transfer body and a transfer material collectively means a transfer medium.

After a color image is transferred onto the transfer material P by a secondary transfer roller 5*b* as a secondary transfer means, an intermediate transfer material 70 of an endless belt form which has separated the transfer material P removes any residual toner by cleaning means 6*b*.

During the image forming process, the primary transfer roller 5Bk is always in contact with the photoreceptor 1Bk. Other primary transfer rollers 5Y, 5M and 5C are each in contact with the respectively corresponding photoreceptors 1Y, 1M and 1C only when forming its color image.

The secondary transfer roller 5*b* is in contact with the intermediate transfer material 70 of an endless belt form only when the transfer material P passes through to perform secondary transfer.

A housing 8, which can be pulled out from the apparatus body A through supporting rails 82L and 82R, is comprised of image forming sections 10Y, 10M, 10C and 10Bk and the endless belt intermediate transfer unit 7.

Image forming sections 10Y, 10M, 10C and 10Bk are aligned vertically. The endless belt intermediate transfer material unit 7 is disposed on the left side of the photoreceptors 1Y, 1M, 1C and 1Bk. The intermediate transfer material unit 7 comprises the endless belt intermediate transfer material 70 which can be turned with being entrained about rollers 71, 72, 73 and 74, primary transfer rollers 5Y, 5M, 5C and 5Bk, and cleaning means 6*b*.

The image forming apparatus related to the present invention is not only suitably used for general electrophotographic apparatuses such as an electrophotographic copier, a laser printer, and the like, but is also broadly applicable to apparatuses employing electrophotographic technologies for short-run printing, printing plate making, facsimiles and the like.

EXAMPLES

Hereinafter, the present invention is further described by reference to the following specific examples but the embodiments of the present invention are by no means limited thereto. In Examples, unless otherwise noted, the expression, "part(s)" represents parts(s) by mass.

Example 1

Preparation of Photoreceptor

An electrophotographic photoreceptor of the invention was prepared in the manner described below.

Preparation of Particulate Metal Oxide 1:

Into a wet sand mill (containing 0.5 mm diameter alumina beads) were placed 100 parts by mass of tin oxide particles having a number average primary particle size of 20 nm, 30 parts by mass of exemplified compound S-4, as a surface treatment agent, and 1000 parts by mass of methyl ethyl ketone and mixed at 30° C. for 6 hours. Thereafter, methyl ethyl ketone and alumina beads were filtered out and the residue was dried at 60° C. to obtain particulate metal oxide 1.

Preparation of Photoreceptor 1:

Preparation of Conductive Substrate:

The surface of a cylindrical aluminum support was machined to prepare an electrically conductive substrate with a surface roughness (Rz) of 1.5 (μm).

Formation of Intermediate Layer:

A dispersion of the composition described below was diluted two times with an identical solvent, allowed to stand overnight and filtered with a filter (RIJI Mesh 5 μm filter, produced by Nippon Pole Co.) to prepare a coating solution of an intermediate layer.

| | |
|---|---|
| Polyamide resin (CM8000, produced by TORAY Co., Ltd.) | 1 part |
| Titanium oxide (SMT500SAS, Teika Co., Ltd.) | 3 parts |
| Methanol | 10 parts |

Using a sand mill as a dispersing machine, the foregoing composition was batch-wise dispersed over 10 hours.

The thus prepared coating solution was coated on the conductive substrate by a dip coating method and dried so that a dry thickness was 2 μm, whereby an intermediate layer was formed.

Formation of Charge Generation Layer:

The composition described below was mixed over 10 hours by using a sand mill to prepare a coating solution of a charge generation layer.

| | |
|---|---|
| Charge generation material (titanyl phthalocyanine pigment*) | 20 parts |
| Polyvinyl butyral resin (#6000-C, Denki Kagaku Kogyo Co., Ltd.) | 10 parts |
| t-Butyl acetate | 700 parts |
| 4-Methoxy-4-methyl-2-pentanone | 300 parts |

*titanyl phthalocyanine pigment exhibiting a X-ray diffraction spectrum profile having a maximum diffraction peak at 27.3° in a Cu—Kα characteristic X-ray diffraction spectrometry The foregoing coating solution of a charge generation layer was coated on the intermediate layer by a dip coating method and dried to form a charge generation layer at a dry thickness of 0.3 μm.

Formation of Charge Transport Layer:

The composition described below was mixed and dissolved to prepare a coating solution of a charge transport layer.

| | |
|---|---|
| Charge transport material [4,4'-dimethyl-4''-(β-phenylstyryl)triphenylamine] | 225 parts |
| Binder (polycarbonate, Z300, produced by Mitsubishi Gas Kagaku Co., Ltd.) | 300 parts |
| Antioxidant (IRGANOX 1010, produced by Ciba Japan Co.) | 6 parts |
| THF (tetrahydrofuran) | 1600 parts |
| Toluene | 400 parts |
| Silicone oil (KF-54, produced by Shinetsu Kagaku Co., Ltd.) | 1 part |

The foregoing coating solution of a charge transport layer was coated on the charge generation layer by a circular quantity control coating method and dried to form a charge transport layer at a thickness of 20 μm.

Formation of Surface Layer:

The composition described below was dissolved and dispersed to prepare a coating solution for the surface layer.

| | |
|---|---|
| Particulate metal oxide 1 (as prepared above) | 100 parts |
| Polymerizable compound (exemplified compound M-1) | 100 parts |
| Polymerization initiator (IRGACURE 819 produced by Ciba Japan Co.) | 7.5 parts |
| t-Butyl alcohol | 100 parts |

The thus prepared coating solution of a surface layer was coated on the foregoing charge transport layer by using a circular quantity control coater to form a surface layer. The thus formed surface layer was dried, and then placed, under a nitrogen stream, at a distance of 100 mm from a light source to the photoreceptor surface by using a metal halide lamp and was exposed to ultraviolet rays at a lamp output of 4 kW to form a surface layer with a dry thickness of 2.0 μm, whereby a photoreceptor 1 was prepared.

Preparation of Photoreceptors 2-21:

Photoreceptors 2 to 21 were each prepared in the same manner as the foregoing photoreceptor 1, except that the amounts of a polymerizable compound and of a particulate metal oxide were varied, as shown in Table 1 with the proviso that no metal oxide was added to a photoreceptor 13.

Evaluation

The thus prepared photoreceptors were evaluated, as below.

Flaw Resistance:

Each of the thus prepared photoreceptors was loaded to a commercially available tandem full-color hybrid machine bizhub PRO C6500 (produced by Konica Minolta Business Technologies Inc.), in which semiconductor laser exposure of 780 nm, turnover development and an intermediate transfer body was employed. After an A4 size image with a printing ratio of 5% for the respective colors of yellow (Y), magenta (M), cyan (C) and black (Bk) was printed on 100,000 A4-size sheets of neutralized paper under 30° C. and 80% RH, a halftone image was printed over the entire A4-size sheet and evaluated based on the following criteria:

A: No flaw was visually observed on the photoreceptor surface,

B: No marked flaws were visually observed on the photoreceptor surface and no image defect corresponding to a flaw on the photoreceptor surface was observed in a halftone image, C: Slight flaws were visually observed on the photoreceptor surface but no image defect corresponding to a flaw on the photoreceptor surface was observed in a halftone image, D: Marked flaws were visually observed on the photoreceptor surface and image defects corresponding to flaws on the photoreceptor surface were observed in a halftone image.

Abrasion Resistance:

Similarly to the foregoing evaluation of flaw resistance, after an A4 size image with a printing ratio of 5% for the respective colors of yellow (Y), magenta (M), cyan (C) and black (Bk) was printed on 100,000 sheets of A4-size neutralized paper, the abrasion loss of the surface layer of a photoreceptor was determined from the measurement of the thickness of the photoreceptor before and after printing and evaluated based on the criteria below. The thickness measurement of a photoreceptor was conducted by using FISCHER SCOPE mms, made by Fischer Instrument Co.

A: An abrasion loss of less than 0.3 μm,

B: An abrasion loss of not less than 0.3 μm and less than 0.5 μm,

C: An abrasion loss of not less than 0.5 μm and less than 1.0 μm,

D: An abrasion loss not less than 1.0 μm.

Crack Resistance:

Similarly to the foregoing evaluation for flaw resistance, after an A4 size image with a printing ratio of 5% for the respective colors of yellow (Y), magenta (M), cyan (C) and black (Bk) was printed on 100,000 sheets of A4-size neutralized paper, a halftone image was printed over the entire A4-size paper and evaluated based on the following criteria:

A: No marked cracks were visually observed at the interface between the photosensitive layer and the surface layer, and no image defects corresponding to a crack of the photoreceptor were observed in the halftone image, B: Slightly marked cracks were visually observed at the inter face between the photosensitive layer and the surface layer, but no image defects corresponding to the cracks of the photoreceptor were observed in the halftone images, and C: Marked cracks were visually observed in the interface between the photosensitive layer and the surface layer, and image defects corresponding to the crack of the photoreceptor were observed in the halftone images.

Evaluation results are shown in Table 1, in which Ranks "A" and "B" are acceptable in practical use.

As is apparent from the results shown in Table 1, it was proved that the use of any one of the photoreceptors 1-15 fell within the acceptable range in practice in any of characteristics; on the contrary, the use of any one of the photoreceptors 16-21 produced problems in any one of the characteristics.

Example 2

An electrophotographic photoreceptor 22 was prepared in the manner described below.

The surface of a cylindrical aluminum support was machined to prepare an electrically conductive substrate with a surface roughness (Rz) of 0.8 (μm).

Formation of Intermediate Layer:

There was prepared a coating solution for an intermediate layer, having the composition below.

| | |
|---|---|
| Polyamide resin (X1010, produced by Daicel-Degussa Co., Ltd.) | 1 part |
| Titanium oxide (SMT500SAS, Teika Co., Ltd.) | 1.1 parts |
| Ethanol | 20 parts |

Using a sand mill as a dispersing machine, the foregoing composition was batch-wise dispersed over 10 hours.

The thus prepared coating solution was coated on the foregoing conductive substrate by a dip coating method and dried at 110° C. for 20 minutes so that a dry thickness was 2 μm.

Formation of Charge Generation Layer:

The composition described below was mixed over 10 hours by using a sand mill to prepare a coating solution of a charge generation layer.

| | |
|---|---|
| Charge generation material (titanyl phthalocyanine pigment*) | 20 parts |
| Polyvinyl butyral resin (#6000-C, Denki Kagaku Kogyo Co., Ltd.) | 10 parts |

TABLE 1

| Photo- | Metal Oxide | | | | Polymerizable Monomer | | | | Evaluation | | |
|---|---|---|---|---|---|---|---|---|---|---|---|
| receptor No. | Species | Surface treatment Agent | Particle Size (nm) | Amount [part(s)] | Compound | No. of Functional Groups | Reactive Group Equivalent | Amount [part(s)] | Flaw Resistance | Abrasion Resistance | Crack Resistance |
| 1 | $SnO_2$ | S-4 | 20 | 70 | M-1 | 8 | 115 | 100 | A | A | A |
| 2 | $SnO_2$ | S-28 | 20 | 150 | M-2 | 7 | 121 | 100 | A | A | A |
| 3 | $Al_2O_3$ | S-6 | 30 | 200 | M-3 | 8 | 101 | 100 | B | A | A |
| 4 | $SnO_2$ | S-4 | 20 | 200 | M-2 | 7 | 121 | 100 | A | A | A |
| 5 | $SnO_2$ | S-7 | 20 | 150 | M-1 | 8 | 115 | 100 | A | A | A |
| 6 | $SnO_2$ | S-6 | 20 | 100 | M-3 | 8 | 101 | 100 | B | A | A |
| 7 | $SnO_2$ | S-15 | 20 | 180 | M-2 | 7 | 121 | 100 | A | A | A |
| 8 | $TiO_2$ | S-29 | 30 | 80 | M-2 | 7 | 121 | 100 | A | A | A |
| 9 | $SiO_2$ | S-28 | 40 | 200 | M-1 | 8 | 115 | 100 | A | A | A |
| 10 | $Al_2O_3$ | S-6 | 30 | 120 | M-6 | 10 | 117 | 100 | A | B | A |
| 11 | $SnO_2$ | S-15 | 20 | 150 | M-3 | 8 | 101 | 100 | B | A | A |
| 12 | $Al_2O_3$ | S-7 | 30 | 100 | M-1 | 8 | 115 | 100 | A | A | A |
| 13 | None | — | — | — | M-1 | 8 | 115 | 100 | B | B | A |
| 14 | $SnO_2$ | S-4 | 20 | 70 | M-11 | 7 | 138 | 100 | A | A | A |
| 15 | $SnO_2$ | S-4 | 20 | 70 | M-12 | 9 | 122 | 100 | A | B | A |
| 16 | $SnO_2$ | S-1 | 20 | 150 | M-4 | 3 | 99 | 100 | C | C | C |
| 17 | $SnO_2$ | S-3 | 20 | 100 | M-7 | 12 | 119 | 100 | D | C | B |
| 18 | $Al_2O_3$ | S-4 | 30 | 200 | M-5 | 3 | 113 | 100 | C | D | C |
| 19 | $Al_2O_3$ | S-4 | 30 | 100 | M-8 | 7 | 155 | 100 | D | D | A |
| 20 | $Al_2O_3$ | S-4 | 30 | 80 | M-9 | 6 | 127 | 100 | C | D | C |
| 21 | $SnO_2$ | S-4 | 20 | 70 | M-10 | 8 | 94 | 100 | C | C | C |

-continued

| | |
|---|---|
| t-Butyl acetate | 700 parts |
| 4-Methoxy-4-methyl-2-pentanone | 300 parts |

*titanyl phthalocyanine pigment exhibiting a X-ray diffraction spectrum profile having a maximum diffraction peak at 27.3° in a Cu—Kα characteristic X-ray diffraction spectrometry The foregoing coating solution for a charge generation layer was coated on the intermediate layer by a dip coating method and dried to form a charge generation layer with a 0.3 μm dry thickness.

Formation of Charge Transport Layer:

The composition described below was mixed and dissolved to prepare a coating solution of a charge transport layer.

| | |
|---|---|
| Charge transport material (Compound A) | 150 parts |
| Binder (polycarbonate, Z300, produced by Mitsubishi Gas Kagaku Co., Ltd.) | 300 parts |
| Antioxidant (IRGANOX 1010, produced by Ciba Japan Co.) | 6 parts |
| Toluene/tetrahydrofuran (1/9 by volume) | 2000 parts |
| Silicone oil (KF-54, produced by Shinetsu Kagaku Co., Ltd.) | 1 part |

The foregoing coating solution of a charge transport layer was coated on the charge generation layer by a dip coating method and dried at 110° C. for 60 minutes to form a charge transport layer with a thickness of 20 μm.

Compound A

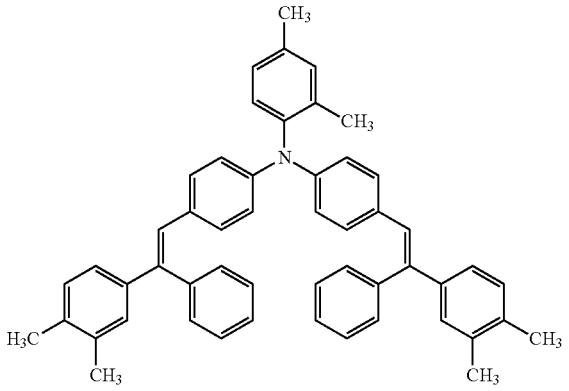

Formation of Surface Layer:

The composition described below was dissolved and dispersed.

| | |
|---|---|
| Particulate metal oxide* | 100 parts |
| Polymerizable compound A (Compound M-1) | 20 parts |
| Polymerizable compound B (Compound M-5 exhibiting a viscosity of 44 mPa · s at 25° C.) | 80 parts |
| Isopropyl alcohol | 500 parts |

*Tin oxide particles of number average primary particle size of 20 nm, and surface-treated with the same amount of S-13

The foregoing composition was dispersed by a sand mill over 10 hours, and further thereto, 30 parts of a polymerization initiator (IRGACURE 369, produced by Ciba Japan Co) was added and stirred with shielding light to prepare a coating solution for a surface layer (which was stored under light-shielding). The thus prepared coating solution was coated on the charge transport layer by a circular slide hopper coater. The thus coated layer was dried for 20 minutes (step for drying solvent) and then exposed to a metal halide lamp (500 W) at the position of 100 mm for 1 minutes with rotating the photoreceptor (ultraviolet-curing step) to form a 3 μm thick surface layer.

Preparation of Photoreceptors 23-31:

Photoreceptors 23 to 31 were each prepared in the same manner as the foregoing photoreceptor 22, except that materials used in the surface layer were varied as shown in Table 2.

Preparation of Photoreceptors 32:

Photoreceptor 32 was prepared in the same manner as Photoreceptor 22, except that the particulate metal oxide was excluded from the surface layer.

TABLE 2

| | Metal Oxide | | | | Polymerizable Compound A | | | Polymerizable Compound B | | | |
|---|---|---|---|---|---|---|---|---|---|---|---|
| Photo-receptor No. | Species | Surface Treatment Agent | Particle Size (nm) | Amount [part(s)] | Compound | No. of Functional Groups | Amount [part(s)] | Compound | No. of Functional Groups | Viscosity at 25° C. (mPa · s) | Amount [part(s)] |
| 22 | $SnO_2$ | S-13 | 20 | 100 | M-1 | 8 | 20 | M-5 | 3 | 44 | 80 |
| 23 | $SnO_2$ | S-7 | 20 | 150 | M-2 | 7 | 50 | M-15 | 2 | 700 | 50 |
| 24 | $Al_2O_3$ | S-13 | 30 | 200 | M-1 | 8 | 90 | M-5 | 3 | 44 | 10 |
| 25 | $SnO_2$ | S-29 | 20 | 80 | M-3 | 8 | 70 | M-5 | 3 | 44 | 30 |
| 26 | $SnO_2$ | S-10 | 20 | 100 | M-3 | 8 | 80 | M-4 | 3 | 110 | 20 |
| 27 | $SnO_2$ | S-13 | 20 | 200 | M-3 | 8 | 10 | M-14 | 4 | 342 | 90 |
| 28 | $TiO_2$ | S-29 | 6 | 100 | M-1 | 8 | 50 | M-5 | 3 | 44 | 50 |
| 29 | $SiO_2$ | S-4 | 40 | 200 | M-3 | 8 | 50 | M-15 | 2 | 700 | 50 |

TABLE 2-continued

| | Metal Oxide | | | | Polymerizable Compound A | | | Polymerizable Compound B | | | |
|---|---|---|---|---|---|---|---|---|---|---|---|
| Photo-receptor No. | Species | Surface Treatment Agent | Particle Size (nm) | Amount [part(s)] | Compound | No. of Functional Groups | Amount [part(s)] | Compound | No. of Functional Groups | Viscosity at 25° C. (mPa · s) | Amount [part(s)] |
| 30 | $SnO_2$ | S-5 | 20 | 120 | M-6 | 10 | 30 | M-14 | 4 | 342 | 70 |
| 31 | $Al_2O_3$ | S-7 | 30 | 100 | M-3 | 8 | 70 | M-16 | 2 | 130 | 30 |
| 32 | None | — | — | — | M-1 | 8 | 20 | M-5 | 3 | 44 | 80 |

M-14: pentaerythritol tetraacrylate

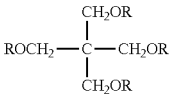

M-15: ethoxylated bisphenol A dimethacrylate

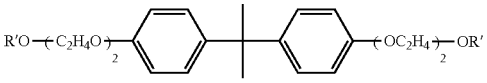

M-16: tricyclodecanedimethanol diacrylate

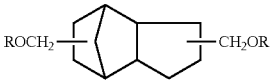

In the foregoing exemplified compounds, designations, R and R' represent the following structures, respectively.

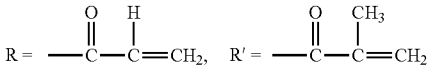

Evaluation

The thus prepared photoreceptors were each evaluated by using a commercially available full-color hybrid machine bizhub PRO C6500 (produced by Konica Minolta Business Technologies Inc.), in which semiconductor laser exposure of 600 dpi and 780 nm was employed. The full-color hybrid machine was provided with four image forming units and photoreceptors of the respective image forming units were unified to the same one (for example, in the case of photoreceptor 22, four photoreceptors were prepared), whereby evaluation was performed. In the respective evaluations, an A4 size image with a printing ratio of 2.5% for the respective colors of yellow (Y), magenta (M), cyan (C) and black (Bk) was printed on 500,000 sheets of A4-size neutralized paper under 30° C. and 80% RH to perform an image printing test and thereafter, evaluation was made under the respective environmental conditions, as set forth below.

Image Unsharpness:

After performing the image printing test of 500,000 sheets under an environment of 30° C. and 80% RH, the main power source of the machine was promptly powered off and after 12 hours, the source was powered on and immediately after becoming the state capable of being printed, a halftone image (0.4 of a relative reflection density measured by a Macbeth densitometer) was printed on the entire A3 size neutralized paper sheet and a 6 dot grid pattern image was printed on the entire A3 size sheet. The states of the printed images were visually observed and evaluated based on the following criteria:

A: No image unsharpness was observed in both the halftone image and the grid pattern image (excellent), B: Only in the halftone image, a density lowering of a strip form was slightly observed in the longitudinal direction of a photoreceptor (but being acceptable in practice), C: A deficit of the grid pattern image, due to occurrence of image unsharpness or thinning of line width (unacceptable in practice).

Flaw Resistance:

After printed on 500,000 sheets of A4-size neutralized paper, as described above, a halftone image was printed on the entire A3 size paper sheet and evaluated based on the following criteria:

A: No surface flaw was visually observed on the photoreceptor surface and no image defect due to a flaw of the photoreceptor was observed in the halftone image (excellent), B: Slight surface flaws were visually observed on the photoreceptor surface but no image defect due to the flaws of the photoreceptor was observed in the halftone image (acceptable in practice), C: Marked surface flaws were visually observed on the photoreceptor surface and image defects due to flaws of the photoreceptor were observed in the halftone image (unacceptable in practice).

Abrasion Resistance of Photoreceptor:

Each of the photoreceptors was evaluation with respect to its abrasion loss between before and after printing of 500,000 sheets of A4-size neutralized paper under an environment of 30° C. and 80% RH, as described above. The thickness of the photosensitive layer was measured at random at ten points in areas of its uniform thickness and an average value thereof was defined as the thickness of the photosensitive layer. The thickness measurement was conducted by using an overcurrent type thickness measuring instrument (EDDY 560C, made by Helmut Fischer Gmbte Co.). The difference in thickness between before and after printed on 500,000 sheets was defined as abrasion loss of a photoreceptor, and evaluated based on the following criteria:

A: An abrasion loss of not more than 0.7 μm (excellent),

B: An abrasion loss of 0.8 to 2 μm (acceptable in practice),

C: An abrasion loss of more than 2 μm (unacceptable in practice).

Crack Resistance:

After printed on 500,000 sheets of A4-size neutralized paper, as described above, a halftone image was printed on the overall A3 size paper and evaluated with respect to crack resistance, based on the following criteria:

A: No marked crack was visually observed in the interface between the photosensitive layer and the surface layer, and no image defect corresponding to a crack of the photoreceptor was observed in a halftone image, B: Slightly marked cracks were visually observed in the interface between the photosensitive layer and the surface layer, but no image defect corresponding to the cracks of the photoreceptor was observed in a halftone image, and C: Marked cracks were visually observed in the interface between the photosensitive layer and the surface layer, and an image defect corresponding to the crack of the photoreceptor was observed in a halftone image.

TABLE 3

| Photo-receptor No. | Evaluation | | | | |
|---|---|---|---|---|---|
| | Image Unsharpness | Flaw Resistance | Abrasion Resistance | Crack Resistance | Remark |
| 22 | A | A | A | A | Inv. |
| 23 | A | A | B | A | Inv. |
| 24 | A | B | B | A | Inv. |
| 25 | A | A | A | B | Inv. |
| 26 | A | B | A | B | Inv. |
| 27 | B | A | B | A | Inv. |
| 28 | B | B | B | A | Inv. |
| 29 | B | B | A | A | Inv. |
| 30 | B | A | A | A | Inv. |
| 31 | A | A | B | B | Inv. |
| 32 | B | B | B | B | Inv. |

As is apparent from Table 3, it was proved that photoreceptors of the present invention were excellent or no problem in practical use in any of evaluation items.

What is claimed is:

1. An electrophotographic photoreceptor comprising, on an electrically conductive substrate, a photosensitive layer and a surface layer provided sequentially in that order, wherein the surface layer is a layer formed by polymerizing a polymerizable compound (I) containing seven to ten functional groups and exhibiting a reactive group equivalent of not more than 140 and not less than 100, wherein the functional groups are either acryloyloxy groups or methacryloyloxy groups, and wherein the surface layer contains a particulate metal oxide.

2. The electrophotographic photoreceptor of claim 1, wherein the polymerizable compound (I) contains seven or eight functional groups.

3. The electrophotographic photoreceptor of claim 1, wherein the polymerizable compound (I) is a polymerizable monomer or oligomer containing either acryloyloxy groups or methacryloyloxy groups in the molecule.

4. The electrophotographic photoreceptor of claim 3, wherein the polymerizable compound (I) is a polymerizable monomer or oligomer containing methacryloyloxy groups in the molecule.

5. The electrophotographic photoreceptor of claim 1, wherein the particulate metal oxide is at least one selected from the group consisting of an aluminum oxide, a tin oxide and a titanium oxide.

6. The electrophotographic photoreceptor of claim 1, wherein the particulate metal oxide is metal oxide particles which were surface treated with a surface treatment agent.

7. The electrophotographic photoreceptor of claim 6, wherein the surface treatment agent is a silicon compound containing an acryloyl group or a methacryloyl group.

8. The electrophotographic photoreceptor of claim 1, wherein the surface layer is formed by polymerizing a mixture of the polymerizable compound (I) and a polymerizable compound (II) containing a functional group and, exhibiting a viscosity of 30 to 3000 mPa·s at 25° C.

9. The electrophotographic photoreceptor of claim 8, wherein the polymerizable compound (II) is a compound containing two to four acryloyl groups or a compound containing two to four methacryloyl groups.

* * * * *